US012158021B2

(12) United States Patent
Chen et al.

(10) Patent No.: US 12,158,021 B2
(45) Date of Patent: Dec. 3, 2024

(54) THREE-DIMENSIONAL ISOLATOR FOR VIBRATION-SEISMIC DUAL CONTROL

(71) Applicant: Guangzhou University, Guangdong (CN)

(72) Inventors: Yangyang Chen, Guangdong (CN); Zhisen Huang, Guangdong (CN); Fulin Zhou, Guangdong (CN); Chaoyong Shen, Guangdong (CN); Wei Gong, Guangdong (CN); Zhenyu Yang, Guangdong (CN)

(73) Assignee: GUANGZHOU UNIVERSITY, Guangdong (CN)

( * ) Notice: Subject to any disclaimer, the term of this patent is extended or adjusted under 35 U.S.C. 154(b) by 124 days.

(21) Appl. No.: 17/950,370

(22) Filed: Sep. 22, 2022

(65) Prior Publication Data

US 2023/0183996 A1 Jun. 15, 2023

(30) Foreign Application Priority Data

Dec. 10, 2021 (CN) ..... 202111508575.0

(51) Int. Cl.
*E04H 9/00* (2006.01)
*E04H 9/02* (2006.01)
*E04B 1/98* (2006.01)

(52) U.S. Cl.
CPC ..... *E04H 9/021* (2013.01); *E04H 9/00* (2013.01); *E04H 9/022* (2013.01); *E04B 1/98* (2013.01); *E04H 9/02* (2013.01); *E04H 9/0237* (2020.05)

(58) Field of Classification Search
None
See application file for complete search history.

(56) References Cited

U.S. PATENT DOCUMENTS 2,660,386 A * 11/1953 Munro ..... F16F 3/10 248/574
3,921,240 A * 11/1975 Fyfe ..... E04B 1/36 14/73.5

(Continued)

FOREIGN PATENT DOCUMENTS

EP 0583923 A1 * 8/1993
KR 100987180 B1 * 7/2009

(Continued)

*Primary Examiner* — Phi D A
(74) *Attorney, Agent, or Firm* — HOWSON & HOWSON, LLC

(57) ABSTRACT

A three-dimensional isolator for vibration-seismic dual control. The three-dimensional isolator comprises an isolator body and isolator components, wherein the isolator body comprises a plurality of middle-layer connecting plates and a plurality of rubber module units, the middle-layer connecting plates are vertically arranged at intervals, and the rubber module units are arranged on the upper surfaces and the lower surfaces of the middle-layer connecting plates in parallel and connect the middle-layer connecting plates into a whole; and the isolator components comprise cover plate components and pre-tightening pieces, the cover plate components comprise an upper cover plate, a lower cover plate and side walls which define an isolator cavity, a flange plate is arranged on the top of the side wall, a gap is reserved between the upper cover plate and the flange plate.

10 Claims, 5 Drawing Sheets

(56) References Cited

U.S. PATENT DOCUMENTS

| | | | | | |
|---|---|---|---|---|---|
| 4,033,005 | A * | 7/1977 | Czernik | E01D 19/042 | 14/73.5 |
| 5,014,474 | A * | 5/1991 | Fyfe | E02D 31/08 | 248/634 |
| 5,509,238 | A * | 4/1996 | Scalfati | E04H 9/021 | 52/167.7 |
| 5,862,638 | A * | 1/1999 | Holland | F16F 1/40 | 248/562 |
| 6,250,441 | B1 * | 6/2001 | Shimoda | F16F 9/103 | 267/136 |
| 9,903,433 | B2 * | 2/2018 | Sato | F16F 15/04 | |
| 2012/0304587 | A1 * | 12/2012 | Kenho | F16F 15/06 | 52/699 |
| 2014/0245670 | A1 * | 9/2014 | Cho | E04H 9/022 | 52/741.1 |
| 2021/0310538 | A1 * | 10/2021 | Yang | E04B 1/98 | |

FOREIGN PATENT DOCUMENTS

| | | | | |
|---|---|---|---|---|
| WO | WO-9514830 | A1 * | 6/1995 | E04H 9/022 |
| WO | WO-0031436 | A1 * | 6/2000 | E04H 9/022 |
| WO | WO-2014033986 | A1 * | 3/2014 | E01D 19/041 |
| WO | WO-2014192289 | A1 * | 12/2014 | C08K 3/04 |
| WO | WO-2014193328 | A1 * | 12/2014 | E01D 19/041 |
| WO | WO-2016125454 | A1 * | 8/2016 | E04H 9/02 |

* cited by examiner

THREE-DIMENSIONAL ISOLATOR FOR VIBRATION-SEISMIC DUAL CONTROL

CROSS REFERENCE TO RELATED APPLICATION

This patent application claims the benefit and priority of Chinese Patent Application No. 202111508575.0, filed on Dec. 10, 2021, the disclosure of which is incorporated by reference herein in its entirety as part of the present application.

TECHNICAL FIELD

The present disclosure relates to the technical field of seismic isolators, in particular to a three-dimensional isolator for vibration-seismic dual control.

BACKGROUND ART

The seismic isolator is a key component applied in the seismic isolation technology. As an increasingly mature product, seismic isolators have been used in a large number of construction projects. By installing seismic isolators at specific positions in buildings or structures, the self-oscillation period of the upper structure can be prolonged, the seismic response of the upper structure can be reduced, and seismic protection of the upper structure can be realized.

In recent years, new market developments have put forward new requirements for the performance of seismic isolators. With the intensive development of transportation and urban construction, many buildings, structures or equipment above subway stations or adjacent to the traffic vibration sources need to resist the vibration of the traffic environment in addition to ground motions. In order to ensure the comfort of the buildings and the normal operation of the equipment, the seismic isolator is required to have the functions of both seismic isolation and environmental vibration isolation, namely a vibration-seismic dual control function. In addition, since buildings near transportation junctions are usually high in floors and large in volumes, the size and load-bearing capacity of seismic isolators are increasingly required. However, the existing mature seismic isolator products cannot meet the above requirements.

Firstly, the existing mature seismic isolator products such as liquid natural rubber bearings (LNR isolators), lead rubber bearing (LRB isolators), high-damping rubber bearings (HDR isolators), sliding bearings (SLB isolators) only have the function of isolating the horizontal ground motions and are expensive. According to these seismic isolator products, in order to ensure the isolator stability under the action of vertical loads, the first shape coefficient $S_1$ (the ratio of the effective bearing area of the single rubber layer to the free side surface area) and the second shape coefficient $S_2$ (the ratio of the internal rubber layer diameter or effective width to the total internal rubber thickness) are both large values ($S_1$ being greater than 15, $S_2$ being greater than 5), so that the vertical rigidity of the isolator is large and does not have the vertical vibration isolation function.

Secondly, at present, the mainstream way to improve the vertical vibration isolation performance of seismic isolators is to use thickly laminated (thick) rubber isolators, that is, to increase the thickness of the single rubber layer of the isolator, so that the free surface area of the single layer of rubber is increased. However, the way to reduce the vertical rigidity of the isolator is still very limited, and the reasons mainly lie in that in order to maintain the stability of the isolator and the structural safety, the increase of the thickness of the single layer of rubber is relatively limited, and only the first shape coefficient $S_1$ can be reduced to a limited extent, so that the vibration isolation frequency cannot be decreased to below 10 Hz in the actual engineering application, efficient vibration isolation cannot be achieved, the amplification of the low frequency band components of the traffic environment vibration may be caused, the vibration isolation function is dissipated, and the isolator is difficult to popularize.

Thirdly, another way to improve the vertical vibration isolation performance of the seismic isolator is to integrate the traditional seismic isolator with vertical vibration isolation elements in series. For example, butterfly steel springs, bolted steel springs and other components are serially added on the top of the seismic isolator. However, the same way cannot achieve efficient and practical vibration-seismic dual control function. The main reasons are as follows. Firstly, in order to reduce the vertical vibration isolation frequency to 10 Hz or even lower, the heights of steel springs and other components must be high enough. Due to the adoption of the upper and lower series-connected isolator construction form, the height of the overall isolator is greatly increased, the isolator shape is fine and high, and the spring almost does not have the ability to resist buckling, so that the lateral buckling prevention stability of the isolator under the long-term bearing and transient ground motions is significantly reduced, and structural safety risks are caused. Secondly, the damping of the steel spring is much lower than that of the rubber material, and the steel spring is difficult to meet the optimal damping requirement of the vibration isolator. Because of the local vibration mode of the steel spring, the high-frequency vibration component can smoothly penetrate through the isolator to the upper part for propagation to form a high-frequency passing phenomenon, and the vibration isolation effect is reduced. In addition, the lateral force resistance of the series-connected vertical springs and other components is very low, and the horizontal limit is need, so that the spring does not produce horizontal displacement under the action of wind load. However, the physical contact of the limiting components in turn causes the physical transmission of vertical vibration, so that the vibration isolation function of the isolator for the vibration of the traffic environment is dissipated, and the contradiction cannot be solved.

Fourthly, in order to adapt to the seismic isolation requirement of high-rise or high-volume buildings, it is necessary to use the isolator with large bearing capacity, so that the sizes (diameter, side length and height) of the above traditional seismic isolator products are larger and larger, and the cost is high. As the traditional rubber seismic isolator is manufactured by the whole high-pressure vulcanization process, the high-pressure tonnage, mold volume and quantity of large isolators, vulcanization period of large isolators are several times or even tens of times smaller than those of small isolator products. The precision control of steel plate laminated rubber with large area is very difficult, and the process precision of mass production is difficult to control. The tonnage and performance of the vulcanizing machine equipment and the quality control of the whole process of the isolator need high requirements. The configuration and operation and maintenance cost of large-tonnage vulcanizing machine is increased exponentially compared with the small vulcanizing machine, and the product yield is also decreased, so that the manufacturing cost of the large isolator is high, and the market promotion of the product is restricted.

Fifthly, at present, the vertical rigidity of the vibration isolator considering the vertical vibration isolation function is much lower than that of the traditional seismic isolator, so that the vertical deformation of the isolator in the construction and installation process becomes a non-ignorable factor, causing difficulties in construction elevation and precision control. In addition, after installation, the deformation difference of the isolator at different parts caused by design errors and construction errors may cause uneven settlement of the structure, and even affect the structural safety and the using function.

Above all, there is an urgent need to develop a three-dimensional isolator with a vibration-seismic dual control function to meet the increasing market demands.

SUMMARY

The present disclosure aims to provide a three-dimensional isolator for vibration-seismic dual control. The three-dimensional isolator has the advantages of being low in vertical rigidity, high in damping, high in stability, good in seismic isolation and vibration isolation effect, controllable in manufacturing process, low in cost and the like.

The present disclosure provides a three-dimensional isolator for vibration-seismic dual control, comprising:

an isolator body, the isolator body comprising a plurality of middle-layer connecting plates and a plurality of rubber module units, the middle-layer connecting plates being vertically arranged at intervals, and the rubber module units being arranged on the upper surfaces and the lower surfaces of the middle-layer connecting plates in parallel and connecting the middle-layer connecting plates into a whole; and;

isolator components, the isolator components comprising cover plate components and pre-tightening pieces, the cover plate components comprising an upper cover plate, a lower cover plate and side walls which define an isolator cavity, a flange plate being arranged on the top of the side wall, a gap being reserved between the upper cover plate and the flange plate, the isolator body being fixedly arranged in the isolator cavity, and the pre-tightening piece being arranged between the flange plate and the upper cover plate in a penetrating mode so that the isolator body can be in a pre-pressing state.

In the present disclosure, the rubber module unit comprises an upper sealing plate, a lower sealing plate and a rubber pad arranged between the upper sealing plate and the lower sealing plate, and a plurality of steel plates are arranged in the rubber pad at intervals up and down.

Further, a plurality of rubber module units are arranged on the upper surface and the lower surface of each middle-layer connecting plate in parallel, the upper sealing plates of the rubber module units are respectively connected with the middle-layer connecting plates located above the rubber module units, and the lower sealing plates of the rubber module units are respectively connected with the middle-layer connecting plates located below the rubber module units.

Further, the rubber module unit is integrally vulcanized and has standard dimensions.

The three-dimensional isolator in the present disclosure further comprises an upper pre-buried plate arranged above the upper cover plate and a lower pre-buried plate arranged below the lower cover plate, and the upper pre-buried plate and the lower pre-buried plate are fixedly connected with the upper cover plate and the lower cover plate through bolts respectively.

The three-dimensional isolator in the present disclosure further comprises lining plate components, the lining plate components comprise a plurality of lining plates with different thicknesses, and the lining plates are inserted between the lower cover plate and the lower pre-buried plate in the state that the pre-tightening pieces are disassembled.

In the present disclosure, the pre-tightening piece is a pre-tightening screw rod, the upper end and the lower end of the pre-tightening screw rod are tapped, a screw hole is formed in the upper cover plate, the upper end of the pre-tightening screw rod penetrates through the flange plate and is tightly connected with the screw hole of the upper cover plate, and the lower end of the pre-tightening screw rod abuts against the bottom surface of the flange plate through a gasket.

The three-dimensional isolator in the present disclosure further comprises damping arms, the lower end of the damping arm is fixed to the outer end face of the flange plate, and the upper end of the damping arm is connected with the outer end face of the upper pre-buried plate through a flexible connecting cavity.

Further, the flexible connecting cavity is a steel cavity formed in the outer end face of the upper pre-buried plate, rubber pads are attached to the inner wall of the steel cavity, an upper end plate is arranged at the upper end of the damping arm, the upper end plate of the damping arm is arranged in the steel cavity, and the rubber pad wraps the upper end plate.

Further, the damping arm is in a semicircular shape or a curved shape and is made of soft steel coated lead or soft steel.

The embodiment of the present disclosure at least has the following advantages.

Firstly, according to the three-dimensional isolator for vibration-seismic dual control in the present disclosure, the isolator body is formed by assembling a plurality of rubber module units in a layer parallel mode through a plurality of middle-layer connecting plates, namely the isolator body adopts a plurality of rubber module units with small volume to replace a traditional laminated rubber isolator to be vulcanized into an integrated rubber layer. The isolator has the beneficial effects that under the condition of the same pressure-bearing area, compared with the free side surface area of the rubber layer of the traditional laminated rubber isolator, the free side surface area of the rubber layer of the isolator body is increased by several times to tens of times, so that the layer thickness of the rubber pad only needs to be slightly increased. Therefore, the first shape coefficient $S_1$ (the ratio of the effective pressure-bearing area of a single rubber layer in the isolator to the free side surface area of the single rubber layer) can be reduced by several times to tens of times, $S_1$ is in strong negative correlation with the vertical rigidity of the isolator, and then the vertical rigidity of the isolator can be efficiently reduced. The isolator can obtain good low-frequency vibration isolation performance, and environmental vibration of most frequency bands can be efficiently isolated.

Secondly, according to the three-dimensional isolator for vibration-seismic dual control in the present disclosure, the rubber module units form a group of rubber pad structures connected in parallel between the two middle-layer connecting plates. The group of rubber pad structures in parallel connection and other same groups of rubber pad structures in parallel connection are sequentially overlapped and are in bolted connection through the adjacent middle-layer connecting plates, so that the isolator body with a plurality of groups of rubber pads in parallel connection overlapped into a whole body is formed. The isolator has the beneficial effects that the distance between the rubber pads of the same group of rubber pad structures in the parallel connection form of the isolator body can be increased as required, so that the overall width of the isolator body is remarkably increased under the condition of the same bearing area of the isolator and the same total thickness of the rubber layers. Therefore, the second shape coefficient $S_2$ (the ratio of the diameter or the effective width of the inner rubber layer to the total thickness of the inner rubber layer) is remarkably increased. Meanwhile, the first shape coefficient $S_1$ is kept unaffected. The lateral buckling prevention stability of the isolator body can be remarkably improved along with the increase of the $S_2$ due to the fact that the $S_2$ is in strong positive correlation with the lateral buckling prevention stability when the isolator is borne. Meanwhile, the vertical rigidity of the isolator is not affected, so that the isolator has good bearing stability.

Thirdly, according to the three-dimensional isolator for vibration-seismic dual control in the present disclosure, the mode of the isolator body that the rubber pad layers of the rubber module units are connected in parallel is adopted, and the popular mode that the traditional seismic isolator is serially connected with vertical seismic isolation elements is not adopted. The isolator has the beneficial effects that the defects that the height of the isolator is too large, the appearance of the isolator is too thin and high, and the lateral buckling prevention stability of the isolator is obviously weakened due to series arrangement are avoided. The defects that a steel spring is low in damping and a vibration propagation high-frequency passing phenomena exist are avoided. Meanwhile, a limiting component under the horizontal ground motions does not need to be adopted, and the defect that the vibration isolation function is lost due to rigid limit is avoided.

Fourthly, according to the three-dimensional isolator for vibration-seismic dual control in the present disclosure, the isolator body is formed by assembling the rubber module units in a layer parallel mode through a plurality of middle-layer connecting plates. The rubber module unit is a rubber pad with standard size and shape and is formed by integrally vulcanizing the upper sealing plate, the lower sealing plate, rubber between the upper sealing plate and the lower sealing plate, and the steel plate. The three-dimensional isolator has the beneficial effects that the isolator body does not need to be integrally vulcanized and formed, and the small standard module units are respectively vulcanized and then assembled to form a large isolator, so that the standardized and fabricated assembling of the isolator is realized. Compared with a mode that a traditional large rubber seismic isolator is integrally vulcanized, the manufacturing process of the isolator body is free of large-tonnage vulcanizing machine or large die mold, so that the equipment cost is greatly saved. Moreover, the isolator body adopts one or a few standardized rubber module units, and a great variety of overall isolator bodies with various specifications can be integrated, so that the process precision of batch production is easier to control, and the product yield is greatly improved. Moreover, due to the adoption of the small rubber module units, the steel plates and the rubber sizing material are convenient to process, and a plurality of small module units are vulcanized at the same time, so that the vulcanizing period is greatly shortened, the cost is obviously reduced, and the isolator has good popularization and application prospects.

Fifthly, according to the three-dimensional isolator for vibration-seismic dual control in the present disclosure, the isolator body is in a pre-pressing state through the pre-tightening screw rod in a fastening state in the transportation, site construction and installation periods. In the service period, the pre-tightening screw rod is removed after the three-dimensional isolator is subjected to complete permanent load of the upper structure. The three-dimensional isolator has the beneficial effects that in the construction and installation process, the isolator body is always in a pre-pressing state, and the vertical deformation amount difficult to control is not released along with the gradual increase of the upper load, so that the construction elevation and accuracy are easier to control.

Sixthly, according to the three-dimensional isolator for vibration-seismic dual control in the present disclosure, after the pre-tightening screw rod is removed in the service period, a jack for jacking can be arranged between the lower side of the flange plate on the side wall of the isolator cavity and the upper surface of the lower pre-buried plate, so that the isolator body is further compressed. Meanwhile, a gap is formed between the lower cover plate and the lower pre-buried plate, the lining plate is inserted in the gap between the lower cover plate and the lower pre-buried plate, and the lower cover plate and the lower pre-buried plate are fixed or welded through bolts. The three-dimensional isolator has the beneficial effects that after installation, the deformation difference of the isolator at different parts caused by design errors and construction errors can be adjusted and eliminated by adding the lining plate, so that the structural safety and the using performance are ensured.

Seventhly, the three-dimensional isolator for vibration-seismic dual control in the present disclosure further can be provided with damping arms. The damping arm can be in a semicircular shape or a curved shape and is made of soft steel coated lead or soft steel. The lower end and the upper end of the damping arm can be fixedly provided with end plates respectively. The end plate at the lower end can be connected or welded with the side wall of the isolator cavity through bolts, and the end plate at the upper end can be connected with the side panel of the upper pre-buried plate through the flexible connecting cavity. The three-dimensional isolator has the beneficial effects that when wind flies, the damping arm does not reach the material yield level, so that the three-dimensional isolator does not deform too much; when an earthquake occurs, the damping arm yields the energy consumption, so that the damping energy consumption capacity of the three-dimensional isolator is improved; and when the environmental vibration occurs, most of environmental vibration cannot spread to the upper structure through the damping arm in the flexible connecting cavity, so that the efficient capacity for isolating environmental vibration is ensured.

Eighthly, the three-dimensional isolator for vibration-seismic dual control in the present disclosure solves the problem that the traditional seismic isolator product is too high in vertical rigidity, and provides an isolator structure capable of efficiently reducing the vertical rigidity of laminated rubber. The three-dimensional isolator solves the problem that the existing isolator for vibration-seismic dual control is low in stability, and provides an isolator structure maintaining the integral stability of the rubber isolator under the design of low vertical rigidity. The three-dimensional isolator solves the problem that the existing isolator for vibration-seismic dual control is too low in steel component damping, has a high-frequency passing phenomena and is interfered with lateral limit, and provides an isolator structure which is high in damping ratio, can avoid the high-frequency passing phenomena and is free of lateral limit.

The three-dimensional isolator solves the problem that the existing large isolator for vibration-seismic dual control is too high in manufacturing process requirement, low in control precision and high in cost, and provides an isolator structure which is controllable in process flow, lower in cost and convenient in popularization and application. The three-dimensional isolator solves the problem that the existing isolator for vibration-seismic dual control is difficult for deformation control of the isolator in the construction process and the height of the isolator is difficult to adjust after construction, and provides an isolator structure with controllable isolator deformation and adjustable height after the isolator is installed.

BRIEF DESCRIPTION OF THE DRAWINGS

In order to illustrate the technical solutions in the embodiment of the present disclosure or in the prior art more clearly, the attached figures needing to be used in the embodiment or in the description in the prior art are simply described. Apparently, the embodiments in the following description are merely a part rather than all of the embodiments of the present disclosure. For those of ordinary skill in the art, under the premise of without contributing creative labor, other attached figures further can be obtained according to these attached figures.

REFERENCE SIGNS IN THE ATTACHED FIGURES

Figure 1:
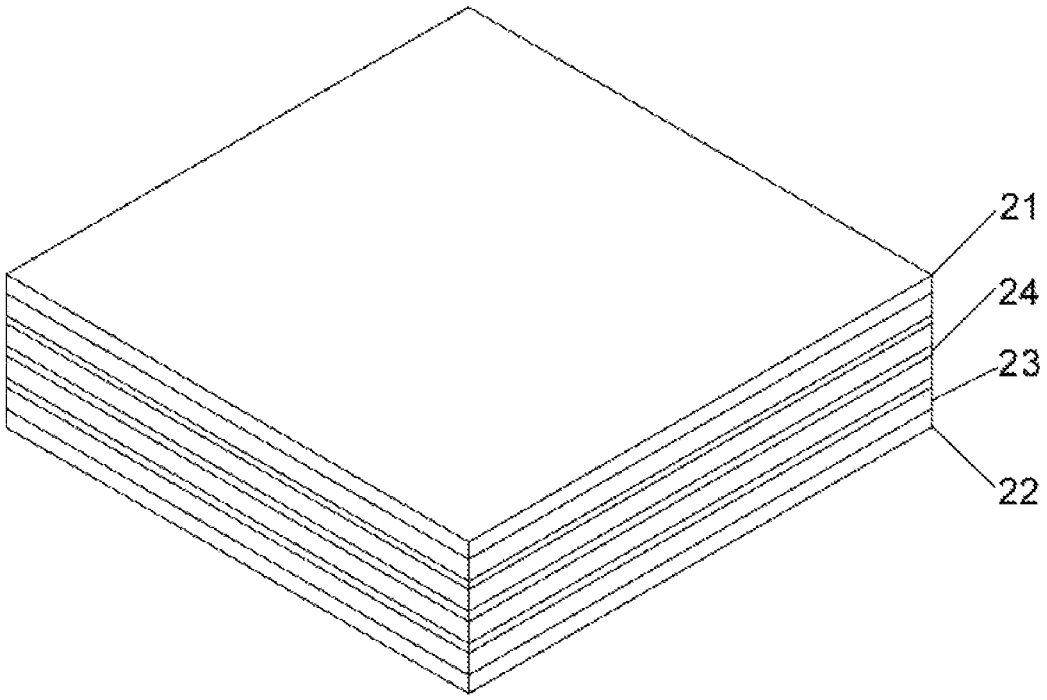
FIG. 1 is a structural schematic diagram of a rubber module unit in an embodiment.

1, middle-layer connecting plate; 2, rubber module unit; 21, upper sealing plate; 22, lower sealing plate; 23, rubber pad; 24, steel plate; 3, upper cover plate; 4, lower cover plate; 5, side wall; 6, flange plate; 7, pre-tightening piece; 8, upper pre-buried plate; 9, lower pre-buried plate; 10, lining plate; 11, damping arm; and 12, jack.

DETAILED DESCRIPTION OF THE EMBODIMENTS

It should be noted that the following detailed description is exemplary and aims to provide further description for the present disclosure. Except as otherwise noted, all techniques and scientific terms used in the present disclosure have same meanings generally understood by ordinary skill in the art in the present disclosure.

It needs to be noted that the terms used herein just describe the specific mode of execution, but not expect to limit the exemplary modes of execution in the disclosure. It is to be understood that the singular forms "a", "an", and "the" include plural referents unless the context clearly dictates otherwise. Moreover, it should be understood that the terms "contain" and/or "comprise" used in the specification indicate characteristics, steps, operations, devices, assemblies and/or their combination.

The following clearly and completely describes the technical scheme in the embodiments of the present disclosure with reference to the attached figures in the embodiments of the present disclosure. Apparently, the described embodiments are merely a part rather than all of the embodiments of the present disclosure. All other embodiments obtained by those skilled in the art based on the embodiments of the present disclosure without creative efforts shall fall within the protection scope of the present disclosure.

Embodiment I

As shown in FIG. 1 to FIGS. 7A-7M, a three-dimensional isolator for vibration-seismic dual control in the embodiment comprises an isolator body and isolator components, wherein the isolator body comprises a plurality of middle-layer connecting plates 1 and a plurality of rubber module units 2, the middle-layer connecting plates 1 are vertically arranged at intervals, and the rubber module units 2 are arranged on the upper surfaces and the lower surfaces of the middle-layer connecting plates 1 in parallel and connect the middle-layer connecting plates 1 into a whole; and the isolator components comprise cover plate components and pre-tightening pieces, the cover plate components comprise an upper cover plate 3, a lower cover plate 4 and side walls 5 which define an isolator cavity, a flange plate 6 is arranged on the top of the side wall 5, a gap is reserved between the upper cover plate 3 and the flange plate 6, the isolator body is fixedly arranged in the isolator cavity, and the pre-tightening piece is arranged between the flange plate 6 and the upper cover plate 3 in a penetrating mode so that the isolator body can be in a pre-pressing state.

As shown in FIG. 1, the rubber module unit 2 comprises an upper sealing plate 21, a lower sealing plate 22 and a rubber pad 23 arranged between the upper sealing plate 21 and the lower sealing plate 22, and a plurality of steel plates 24 are arranged in the rubber pad 23 at intervals up and down.

Figure 2:
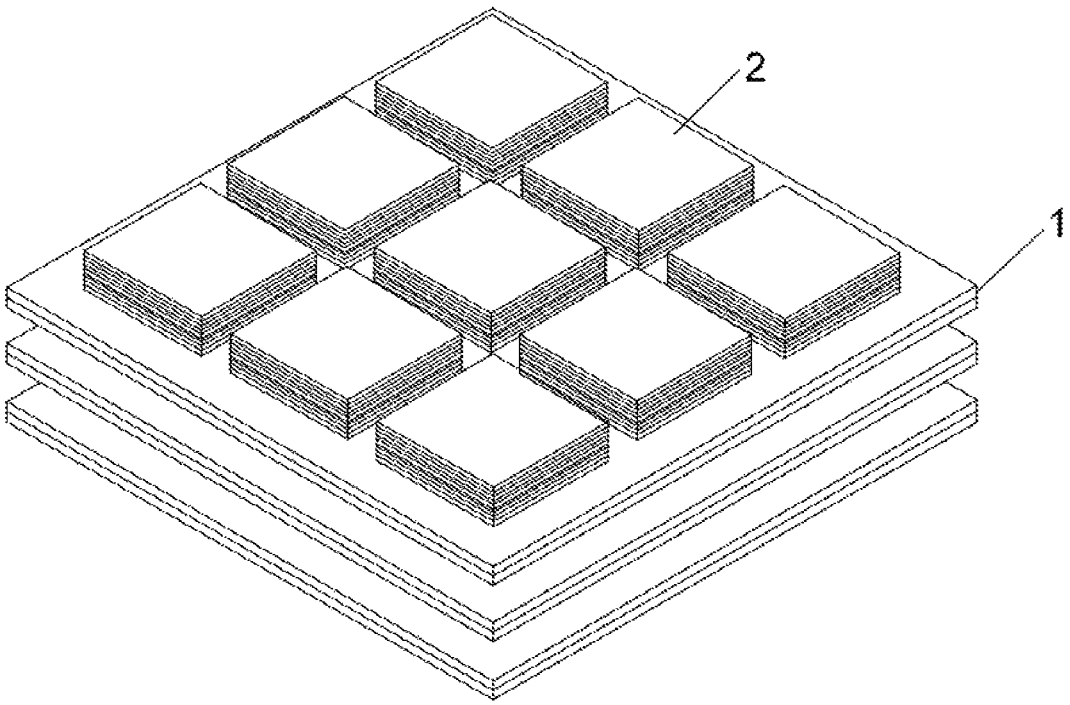
FIG. 2 is a structural schematic diagram of an isolator body in an embodiment.

As shown in FIG. 2, in the isolator body, a plurality of rubber module units 2 are arranged on the upper surface and the lower surface of each middle-layer connecting plate 1 in parallel, the upper sealing plates 21 of the rubber module units 2 are respectively connected with the middle-layer connecting plates 1 located above the rubber module units 2, and the lower sealing plates 22 of the rubber module units 2 are respectively connected with the middle-layer connecting plates 1 located below the rubber module units 2.

The rubber module unit 2 can be integrally vulcanized and has standard dimensions. The specific arrangement mode of the rubber module units 2 arranged on the upper surface and the lower surface of the middle-layer connecting plate 1 in parallel is not strictly limited. The rubber module units 2 can be reasonably arranged according to actual requirements, and can be specifically seen from FIGS. 7A-7M.

In the three-dimensional isolator in the embodiment, the isolator body is formed by assembling the rubber module units 2 in a layer parallel mode through a plurality of middle-layer connecting plates 1. The rubber module unit 2 is a rubber pad with standard size and shape and is formed by integrally vulcanizing the upper sealing plate, the lower sealing plate, rubber between the upper sealing plate and the lower sealing plate, and the steel plate. The middle-layer connecting plate 1 can be made of a steel plate and is connected with the upper sealing plate 21 and the lower sealing plate 22 of the rubber module unit 2 through countersunk bolts. According to the layer parallel connection mode, the upper sealing plates 21 of the rubber module units 2 are connected with the same middle-layer connecting plate 1 on the same side, and the lower sealing plates 22 of the rubber module units 2 are connected with the other middle-layer connecting plate 1 on the same side, so that the rubber module units 2 form a group of rubber pad structures connected in parallel between the two middle-layer connecting plates 1. The group of rubber pad structures in parallel connection and other same groups of rubber pad structures in parallel connection are sequentially overlapped and are in bolted connection through the adjacent middle-layer connecting plates 1, so that the isolator body with a plurality of groups of rubber pads in parallel connection overlapped into a whole body is formed.

In the three-dimensional isolator, the isolator body adopts a plurality of rubber module units 2 with small volume to replace a traditional laminated rubber isolator to be vulcanized into an integrated rubber layer. Under the condition of the same pressure-bearing area, compared with the free side surface area of the rubber layer of the traditional laminated rubber isolator, the free side surface area of the rubber layer of the isolator body is increased by several times to tens of times, so that the layer thickness of the rubber pad 23 only needs to be slightly increased. Therefore, the first shape coefficient $S_1$ (the ratio of the effective pressure-bearing area of a single rubber layer in the isolator to the free side surface area of the single rubber layer) can be reduced by several times to tens of times, $S_1$ is in strong negative correlation with the vertical rigidity of the isolator, and then the vertical rigidity of the isolator can be efficiently reduced. The isolator can obtain good low-frequency vibration isolation performance, and environmental vibration of most frequency bands can be efficiently isolated.

In the three-dimensional isolator, the distance between the rubber pads of the same group of rubber pad structures in the parallel connection form of the isolator body can be increased as required, so that the overall width of the isolator body is remarkably increased under the condition of the same bearing area of the isolator and the same total thickness of the rubber layers. Therefore, the second shape coefficient $S_2$ (the ratio of the diameter or the effective width of the inner rubber layer to the total thickness of the inner rubber layer) is remarkably increased. Meanwhile, the first shape coefficient $S_1$ is kept unaffected. The lateral buckling prevention stability of the isolator body can be remarkably improved along with the increase of the $S_2$ due to the fact that the $S_2$ is in strong positive correlation with the lateral buckling prevention stability when the isolator is borne. Meanwhile, the vertical rigidity of the isolator is not affected, so that the isolator has good bearing stability.

In the three-dimensional isolator, by adopting the mode of the isolator body that the rubber pad layers of the rubber module units are connected in parallel, the defects that the height of the isolator is too large, the appearance of the isolator is too thin and high, and the lateral buckling prevention stability of the isolator is obviously weakened due to series arrangement are avoided. The defects that a steel spring is low in damping and a vibration propagation high-frequency passing phenomena exist are avoided. Meanwhile, a limiting component under the horizontal ground motions does not need to be adopted, and the defect that the vibration isolation function is lost due to rigid limit is avoided.

In the three-dimensional isolator, the rubber module unit 2 can be a rubber pad with standard size and shape and is formed by integrally vulcanizing the upper sealing plate, the lower sealing plate, rubber between the upper sealing plate and the lower sealing plate, and the steel plate. The isolator body does not need to be integrally vulcanized and formed, and the small standard module units are respectively vulcanized and then assembled to form a large isolator, so that the standardized and fabricated assembling of the isolator is realized. Compared with a mode that a traditional large rubber seismic isolator is integrally vulcanized, the manufacturing process of the isolator body is free of large-tonnage vulcanizing machine or large die mold, so that the equipment cost is greatly saved. Moreover, the isolator body adopts one or a few standardized rubber module units 2, and a great variety of overall isolator bodies with various specifications can be integrated, so that the process precision of batch production is easier to control, and the product yield is greatly improved. Moreover, due to the adoption of the small rubber module units, the steel plates and the rubber sizing material are convenient to process, and a plurality of small module units are vulcanized at the same time, so that the vulcanizing period is greatly shortened, the cost is obviously reduced, and the isolator has good popularization and application prospects.

Figure 3:
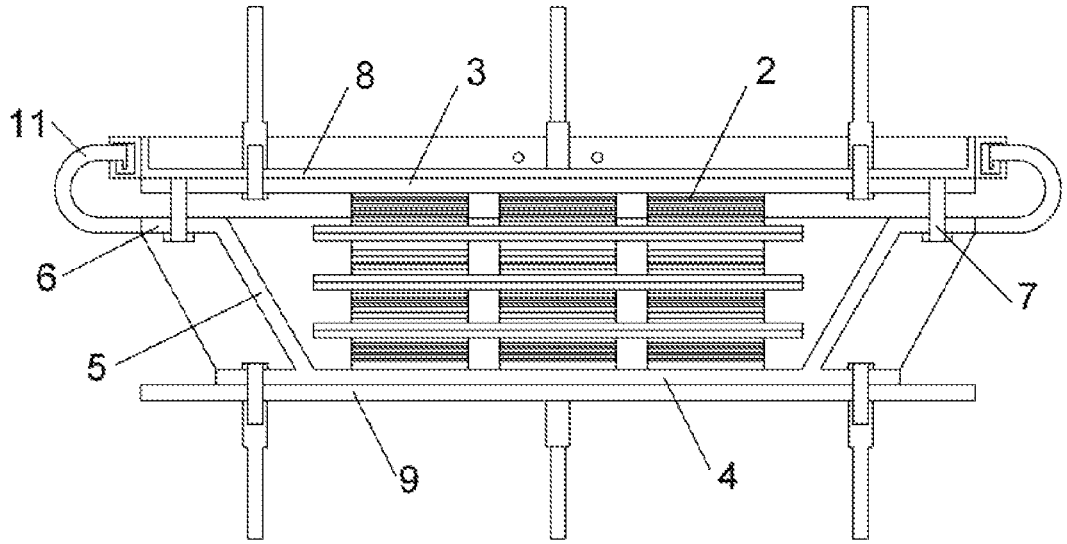
FIG. 3 is a front view of a three-dimensional isolator in an embodiment.
Figure 4:
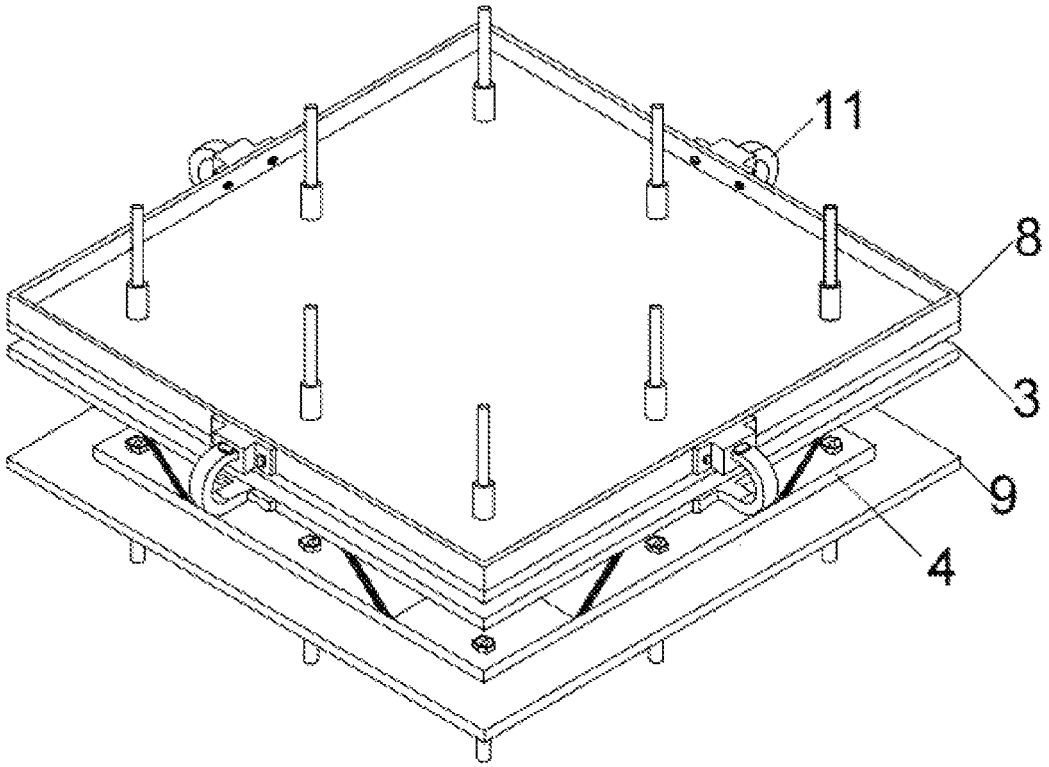
FIG. 4 is a structural schematic diagram of a three-dimensional isolator in an embodiment.

As shown in FIG. 3 and FIG. 4, in the present disclosure, the pre-tightening piece is a pre-tightening screw rod 7, the upper end and the lower end of the pre-tightening screw rod 7 are tapped, a screw hole is formed in the upper cover plate 3, the upper end of the pre-tightening screw rod 7 penetrates through the flange plate 6 and is tightly connected with the screw hole of the upper cover plate 3, and the lower end of the pre-tightening screw rod 7 abuts against the bottom surface of the flange plate 6 through a gasket.

According to the three-dimensional isolator, the isolator body is in a pre-pressing state through the pre-tightening screw rod 7 in the transportation, site construction and installation periods. In the construction and installation process, the isolator body is always in a pre-pressing state, and the vertical deformation amount difficult to control is not released along with the gradual increase of the upper load, so that the construction elevation and accuracy are easier to control. In the service period, the pre-tightening screw rod 7 can be removed after the three-dimensional isolator is subjected to complete permanent load of the upper structure.

The three-dimensional isolator in the embodiment further comprises an upper pre-buried plate 8 arranged above the upper cover plate 3 and a lower pre-buried plate 9 arranged below the lower cover plate 4, and the upper pre-buried plate 8 and the lower pre-buried plate 9 are fixedly connected with the upper cover plate 3 and the lower cover plate 4 through bolts respectively.

Figure 5:
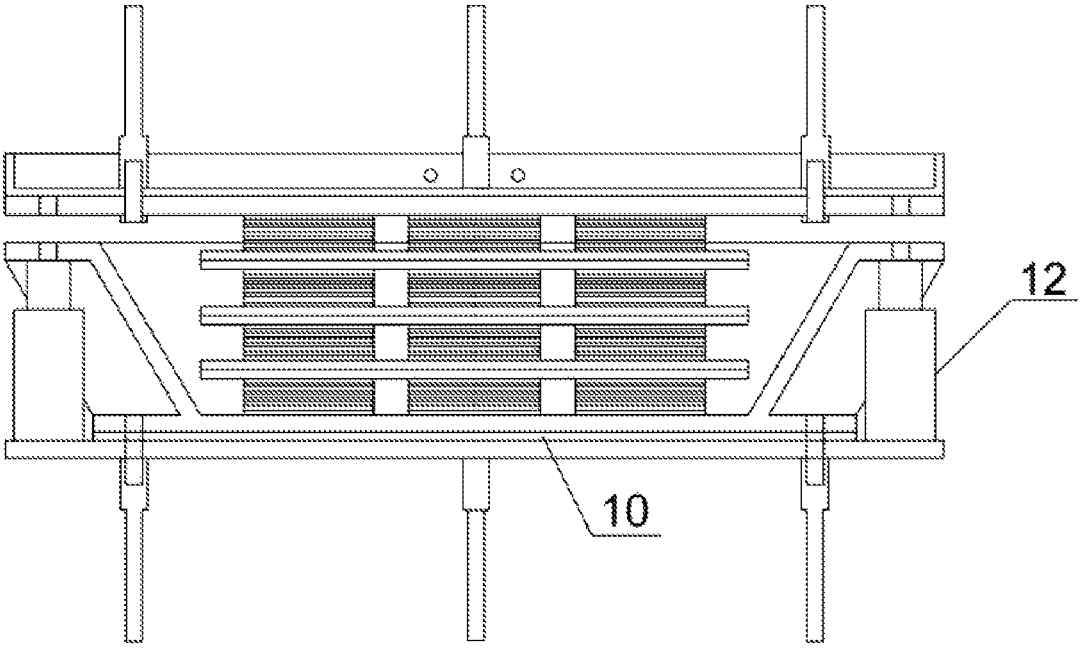
FIG. 5 is a front view of a three-dimensional isolator when lining plates are inserted in an embodiment.
Figure 6:
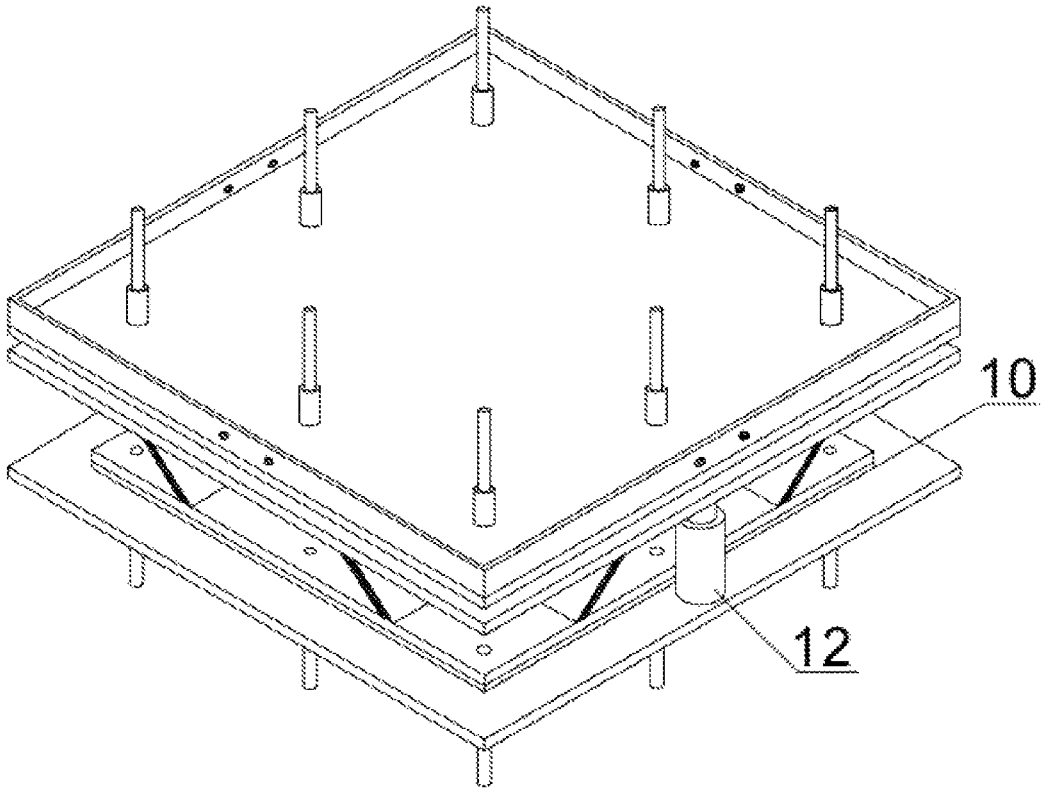
FIG. 6 is a structural schematic diagram of a three-dimensional isolator when lining plates are inserted in an embodiment.
Figure 7A:
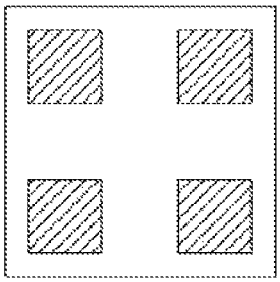
FIGS. 7A-7M are structural schematic diagram of a rubber module unit on a middle-layer connecting plate.
Figure 7B:
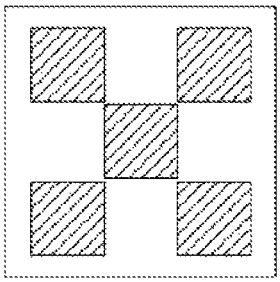
Figure 7C:
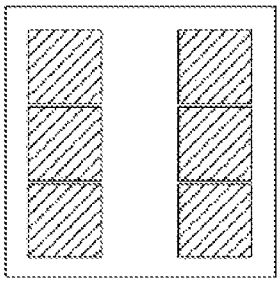
Figure 7D:
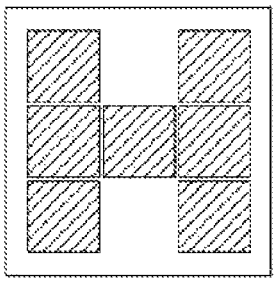
Figure 7E:
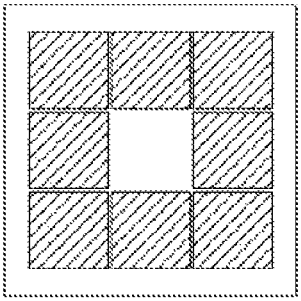
Figure 7F:
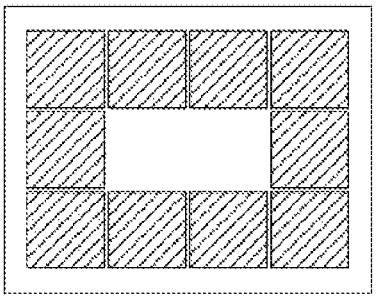
Figure 7G:
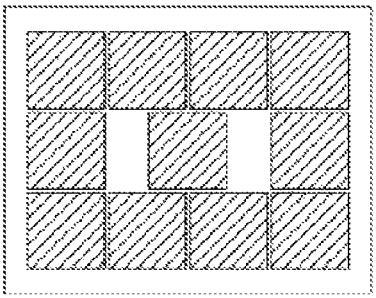
Figure 7H:
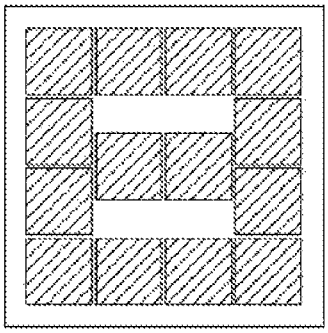
Figure 7I:
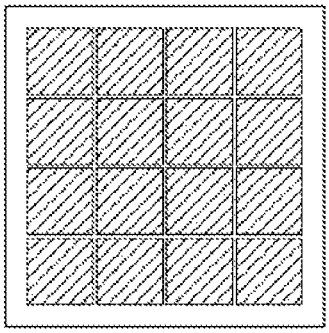
Figure 7J:
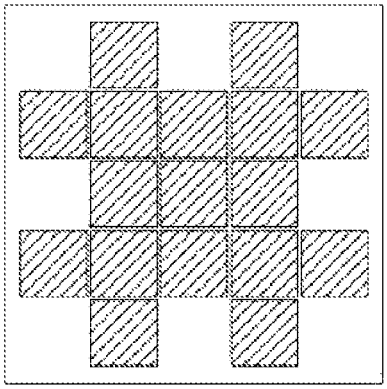
Figure 7K:
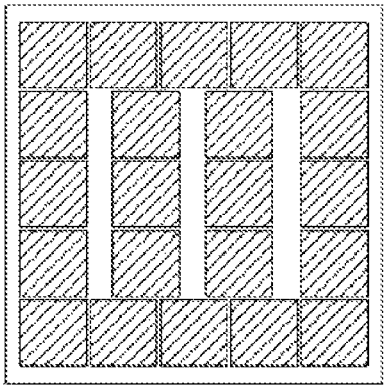
Figure 7L:
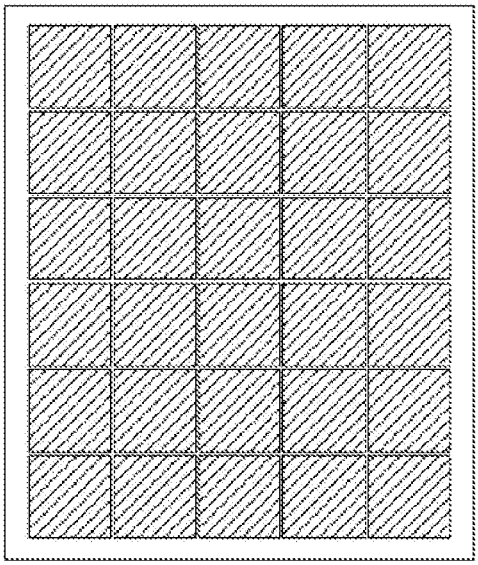
Figure 7M:
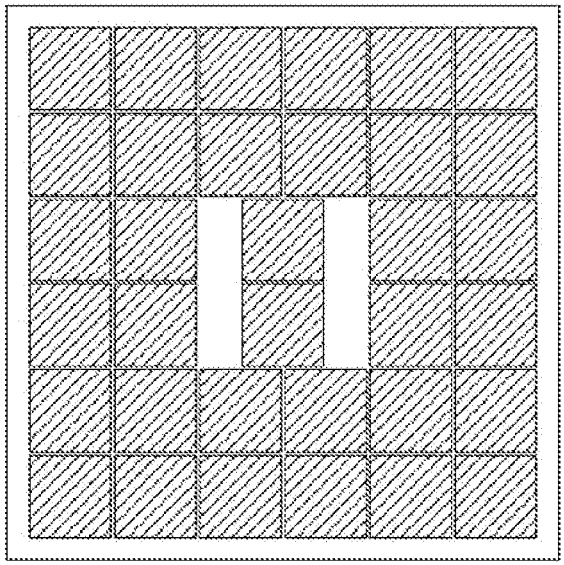

As shown in FIG. 5 and FIG. 6, the three-dimensional isolator in the embodiment further comprises lining plate components, the lining plate components comprise a plurality of lining plates 10 with different thicknesses, and the lining plates 10 are inserted between the lower cover plate 4 and the lower pre-buried plate 9 in the state that the pre-tightening pieces are disassembled.

According to the three-dimensional isolator, after the pre-tightening screw rod 7 is removed in the service period, a jack 12 for jacking can be arranged between the lower side of the flange plate 6 on the side wall 5 of the isolator cavity and the upper surface of the lower pre-buried plate 9, so that the isolator body is further compressed. Meanwhile, a gap is formed between the lower cover plate 4 and the lower pre-buried plate 9, the lining plate 10 is inserted in the gap between the lower cover plate 4 and the lower pre-buried plate 9, and the lower cover plate 4 and the lower pre-buried plate 9 are fixed or welded through bolts. After installation, the deformation difference of the isolator at different parts caused by design errors and construction errors can be adjusted and eliminated by adding the lining plate 10, so that the structural safety and the using performance are ensured.

The three-dimensional isolator in the embodiment further comprises damping arms 11, the lower end of the damping arm 11 is fixed to the outer end face of the flange plate 6, and the upper end of the damping arm 11 is connected with the outer end face of the upper pre-buried plate 8 through a flexible connecting cavity.

The flexible connecting cavity is a steel cavity formed in the outer end face of the upper pre-buried plate 8, rubber pads are attached to the inner wall of the steel cavity, an upper end plate is arranged at the upper end of the damping arm 11, the upper end plate of the damping arm 11 is arranged in the steel cavity, and the rubber pad wraps the upper end plate. Moreover, the damping arm 11 is in a semicircular shape or a curved shape and is made of soft steel coated lead or soft steel.

The three-dimensional isolator further can be provided with damping arms 11. The damping arm 11 is in a semicircular shape or a curved shape and is made of soft steel coated lead or soft steel. The lower end and the upper end of the damping arm 11 can be fixedly provided with end plates respectively. The end plate at the lower end can be connected or welded with the side wall 5 of the isolator cavity through bolts, and the end plate at the upper end can be connected with the side panel of the upper pre-buried plate 8 through the flexible connecting cavity. The three-dimensional isolator has the beneficial effects that when wind flies, the damping arm 11 does not reach the material yield level, so that the three-dimensional isolator does not deform too much; when an earthquake occurs, the damping arm 11 yields the energy consumption, so that the damping energy consumption capacity of the three-dimensional isolator is improved; and when the environmental vibration occurs, most of environmental vibration cannot spread to the upper structure through the damping arm 11 in the flexible connecting cavity, so that the efficient capacity for isolating environmental vibration is ensured.

In the three-dimensional isolator in the embodiment, the isolator components may comprise an upper cover plate 3, a lower cover plate 4, side walls 5, flange plates 6, pre-tightening screw rods 7, an upper pre-buried plate 8, a lower pre-buried plate 9, lining plates 10 and damping arms 11.

The lower cover plate 4 and the side walls can be of an integral structure, and a gap is reserved between the lower side of the upper cover plate 3 and the top of the side wall 5. A flange plate 6 is arranged on the top of the side wall 5, and a through hole is formed in the flange plate 6. A screw hole is formed in the upper cover plate 3. The upper cover 3, the lower cover plate 4 and the side walls 5 define the isolator cavity, and the isolator body is fixed in the isolator cavity.

The pre-buried plates comprise the upper pre-buried plate 8 and the lower pre-buried plate 9, a screw hole is formed in the upper pre-buried plate 8, and the upper pre-buried plate 8 is pre-buried in the upper structure of the seismic isolation and vibration isolation object; and the lower pre-buried plate 9 is connected with the lower cover plate 4 through bolts.

The upper end and the lower end of the pre-tightening screw rod 7 are tapered, and the lower end is configured with a nut and a gasket. In the assembling period in factories, after the three-dimensional isolator is subjected to vertical pre-pressing, the upper end of the pre-tightening screw rod 7 is fastened with the screw hole in the upper cover plate 3 of the isolator cavity. After the lower end of the pre-tightening screw rod 7 penetrates through the through hole in the flange plate 6, the gasket and the nut on the top of the side wall 5 of the isolator cavity in sequence, the pre-tightening screw rod 7 is fastened with the nut, so that the nut abuts against the lower side of the flange plate 6 through the gasket. After the vertical pre-pressing force of the equipment is unloaded, the isolator cavity is still subjected to the tension force of the pre-tightening screw rod 7, and a pre-pressing effect of the three-dimensional isolator is maintained. In the transportation, site construction and installation periods, the pre-tightening screw rod 7 is in a fastening state. In the service period, after the three-dimensional isolator is subjected to complete permanent load of the upper structure, the pre-tightening screw rod 7 is removed.

The lining plate 10 is made of a steel plate, and different thicknesses of lining plates 10 are prepared. After the pre-tightening screw rod 7 is removed in the service period, a jack 12 for jacking can be arranged between the lower side of the flange plate 6 on the side wall 5 of the isolator cavity and the upper surface of the lower pre-buried plate 9, so that the three-dimensional isolator is further compressed. Meanwhile, a gap is formed between the lower cover plate 4 and the lower pre-buried plate, the lining plate 10 is inserted in the gap between the lower cover plate 4 and the lower pre-buried plate 9, and the lower cover plate 4 and the lower pre-buried plate 9 are fixed or welded through bolts.

The damping arm 11 is in a semicircular shape or a curved shape and is made of soft steel coated lead or soft steel. The lower end and the upper end of the damping arm 11 can be fixedly provided with end plates respectively. The end plate at the lower end is connected or welded with the side wall 5 of the isolator cavity through bolts, and the end plate at the upper end is connected with the side panel of the upper pre-buried plate 8 through the flexible connecting cavity. The flexible connecting cavity is a steel cavity fixed on the surface of the side panel of the upper pre-buried plate 8, and is formed by enclosing the outer plate, the inner plate and the side plates. The rubber pads are adhered to the inner wall of the flexible connecting cavity, and the end plate at the upper end of the damping arm 11 is enclosed and wrapped. A hole formed in the outer plate of the flexible connecting cavity is used for penetrating through the damping arm 11. The damping arm 11 is installed after the pre-tightening screw rod 7 is removed in the service period of the three-dimensional isolator.

The three-dimensional isolator for vibration-seismic dual control in the embodiment solves the problem that the traditional seismic isolator product is too high in vertical rigidity, and provides an isolator structure capable of efficiently reducing the vertical rigidity of laminated rubber. The three-dimensional isolator solves the problem that the existing isolator for vibration-seismic dual control is low in stability, and provides an isolator structure maintaining the integral stability of the rubber isolator under the design of low vertical rigidity. The three-dimensional isolator solves the problem that the existing isolator for vibration-seismic dual control is too low in steel component damping, has a high-frequency passing phenomena and is interfered with lateral limit, and provides an isolator structure which is high in damping ratio, can avoid the high-frequency passing phenomena and is free of lateral limit. The three-dimensional isolator solves the problem that the existing large isolator for vibration-seismic dual control is too high in manufacturing process requirement, low in control precision and high in cost, and provides an isolator structure which is controllable in process flow, lower in cost and convenient in popularization and application. The three-dimensional isolator solves the problem that the existing isolator for vibration-seismic dual control is difficult for deformation control of the isolator in the construction process and the height of the isolator is difficult to adjust after construction, and provides an isolator structure with controllable isolator deformation and adjustable height after the isolator is installed.

Finally, it should be noted that the foregoing embodiments are merely intended for describing the technical solutions of the present disclosure, but not for limiting the present disclosure. Although the present disclosure is described in detail with reference to the foregoing embodiments, a person of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. A three-dimensional isolator for vibration-seismic dual control, comprising:

an isolator body, the isolator body comprising a plurality of middle-layer connecting plates and a plurality of rubber module units, the middle-layer connecting plates being vertically arranged at intervals, and the rubber module units being arranged on the upper surfaces and the lower surfaces of the middle-layer connecting plates in parallel and connecting the middle-layer connecting plates into a whole;

isolator components, the isolator components comprising cover plate components and pre-tightening pieces, the cover plate components comprising an upper cover plate, a lower cover plate and side walls which define an isolator cavity, a flange plate being arranged on the top of the side wall, a gap being reserved between the upper cover plate and the flange plate, the isolator body being fixedly arranged in the isolator cavity, and the pre-tightening piece being arranged between the flange plate and the upper cover plate in a penetrating mode so that the isolator body can be in a pre-pressing state;

an upper pre-buried plate arranged above the upper cover plate and a lower pre-buried plate arranged below the lower cover plate, wherein the upper pre-buried plate and the lower pre-buried plate are fixedly connected with the upper cover plate and the lower cover plate through bolts respectively; and lining plate components, wherein the lining plate components comprise a plurality of lining plates with different thicknesses, and the lining plates are inserted between the lower cover plate and the lower pre-buried plate in the state that the pre-tightening pieces are disassembled.

2. The three-dimensional isolator for vibration-seismic dual control according to claim 1, wherein the rubber module unit comprises an upper sealing plate, a lower sealing plate and a rubber pad arranged between the upper sealing plate and the lower sealing plate, and a plurality of steel plates are arranged in the rubber pad at intervals up and down.

3. The three-dimensional isolator for vibration-seismic dual control according to claim 2, wherein a plurality of rubber module units are arranged on the upper surface and the lower surface of each middle-layer connecting plate in parallel, the upper sealing plates of the rubber module units are respectively connected with the middle-layer connecting plates located above the rubber module units, and the lower sealing plates of the rubber module units are respectively connected with the middle-layer connecting plates located below the rubber module units.

4. The three-dimensional isolator for vibration-seismic dual control according to claim 1, wherein the rubber module unit is integrally vulcanized and has standard dimensions.

5. The three-dimensional isolator for vibration-seismic dual control according to claim 2, wherein the rubber module unit is integrally vulcanized and has standard dimensions.

6. The three-dimensional isolator for vibration-seismic dual control according to claim 3, wherein the rubber module unit is integrally vulcanized and has standard dimensions.

7. The three-dimensional isolator for vibration-seismic dual control according to claim 1, wherein the pre-tightening piece is a pre-tightening screw rod, the upper end and the lower end of the pre-tightening screw rod are tapped, a screw hole is formed in the upper cover plate, the upper end of the pre-tightening screw rod penetrates through the flange plate and is tightly connected with the screw hole of the upper cover plate, and the lower end of the pre-tightening screw rod abuts against the bottom surface of the flange plate through a gasket.

8. The three-dimensional isolator for vibration-seismic dual control according to claim 1, further comprising damping arms, wherein the lower end of the damping arm is fixed to the outer end face of the flange plate, and the upper end of the damping arm is connected with the outer end face of the upper pre-buried plate through a flexible connecting cavity.

9. The three-dimensional isolator for vibration-seismic dual control according to claim 8, wherein the flexible connecting cavity is a steel cavity formed in the outer end face of the upper pre-buried plate, rubber pads are attached to the inner wall of the steel cavity, an upper end plate is arranged at the upper end of the damping arm, the upper end plate of the damping arm is arranged in the steel cavity, and the rubber pad wraps the upper end plate.

10. The three-dimensional isolator for vibration-seismic dual control according to claim 8, wherein the damping arm is in a semicircular shape or a curved shape and is made of soft steel coated lead or soft steel.

* * * * *